United States Patent [19]

Jagger

[11] Patent Number: 4,563,816

[45] Date of Patent: Jan. 14, 1986

[54] CUTLERY

[75] Inventor: Vivienne D. Jagger, West Perth, Australia

[73] Assignee: Little People Limited, Hong Kong

[21] Appl. No.: 509,358

[22] Filed: Jun. 30, 1983

[30] Foreign Application Priority Data

Jul. 5, 1982 [GB] United Kingdom ..... 8219408

[51] Int. Cl.[4] ..... B25G 1/00; A47J 43/28

[52] U.S. Cl. ..... 30/343; 30/324; D7/141

[58] Field of Search ..... 30/324, 340, 343, 164.9, 30/329, 162, 125; D7/141, 150, 137

[56] References Cited

U.S. PATENT DOCUMENTS

| | | | |
|---|---|---|---|
| D. 157,842 | 3/1950 | Chinnock | D7/141 |
| D. 166,444 | 4/1952 | Carre | D7/141 |
| D. 171,270 | 1/1954 | Sweeney | D7/141 |
| D. 173,445 | 11/1954 | Locander | D7/141 |
| D. 176,235 | 11/1955 | Short | D7/141 |
| D. 186,125 | 9/1959 | Forsman | D7/141 |
| D. 263,272 | 3/1982 | Jagger | D7/137 |
| D. 271,739 | 12/1983 | Jagger | D7/141 |
| 1,625,003 | 4/1927 | Walker | 30/324 |
| 2,596,255 | 5/1952 | La Tour | 30/324 X |

FOREIGN PATENT DOCUMENTS

| | | |
|---|---|---|
| 0203384 | 9/1923 | United Kingdom . |
| 0229199 | 2/1925 | United Kingdom . |
| 0490823 | 8/1938 | United Kingdom . |
| 0613213 | 6/1946 | United Kingdom . |
| 0690860 | 4/1953 | United Kingdom . |
| 1267333 | 3/1972 | United Kingdom . |
| 2058648A | 4/1981 | United Kingdom . |

OTHER PUBLICATIONS

Maws Design 392, p. 11, Aug. 1981.

Tableware International and Pottery Gazette, p. 17, Nov. 1970.

*Primary Examiner*—Paul A. Bell

*Assistant Examiner*—Paul M. Heyrana, Sr.

*Attorney, Agent, or Firm*—Wood, Herron & Evans

[57] ABSTRACT

Young children often find it difficult to grip and control cutlery since they lack the muscle control possessed by adults. Accordingly, the piece of cutlery described is designed to make it easy for use by a young child and comprises a handle and an operative portion such as a spoon bowl, fork prongs or pusher. The handle is generally of round, barrel-shape for easy fist-like grasping by a small child and has a relatively flattened surface adjacent the operative portion for the ball of the thumb of the child to allow gripping and control of the piece of cutlery between the ball of the thumb and the four fingers grasping the handle. The longitudinal axis of the operative portion is turned in from the longitudinal axis of the handle so that when the handle is grasped, the operative portion is turned towards the body of the user. The invention also covers a set of cutlery comprising a spoon and a fork, the prongs of the fork being preferably turned in from the axis of the handle less than the turning in of the bowl of the spoon from its handle.

14 Claims, 10 Drawing Figures

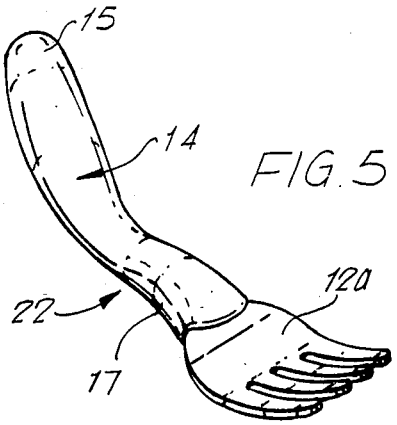
FIG. 5
FIG. 6.
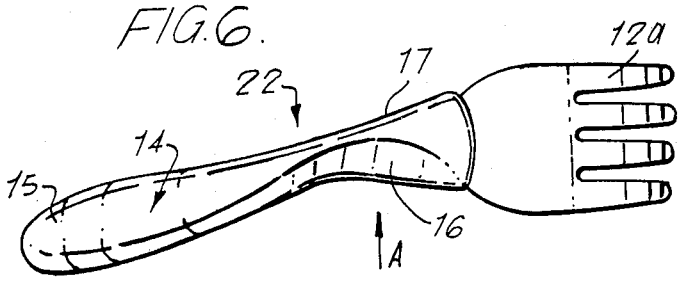
FIG. 7
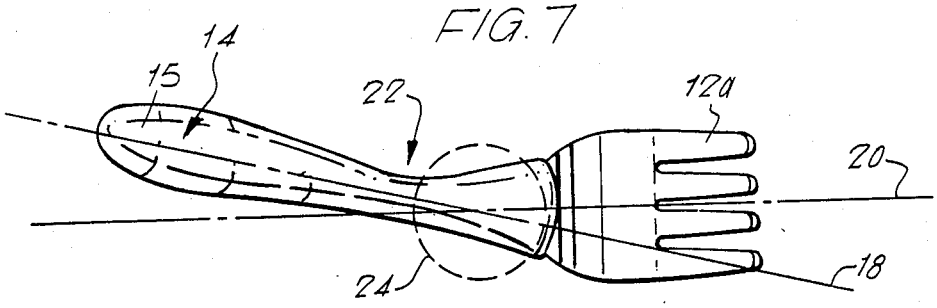
FIG. 8.
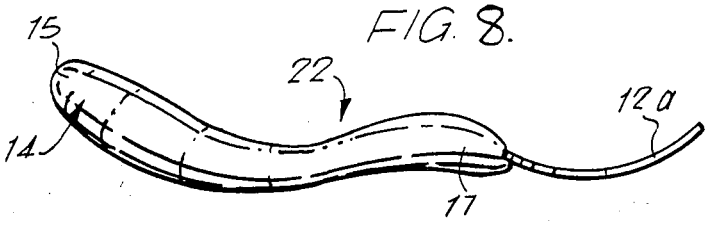

CUTLERY

This invention relates to cutlery and in particular cutlery for use by a young child.

BACKGROUND TO THE INVENTION

Existing cutlery is difficult to hold, grip and control by a small child with little or no muscle control.

As a result, young children cannot feed themselves or do so with great difficulty until they develop proper muscle control.

It is an object of the invention to mitigate or overcome one or more of the above mentioned problems.

BRIEF SUMMARY OF THE INVENTION

According to the invention there is provided a piece of cutlery for use by a young child comprising a handle and an operative portion such as a spoon bowl, fork prongs or pusher, wherein the handle is generally of round, barrel-shape for easy fist-like grasping by a small child, the handle having a relatively flattened surface adjacent the operative portion for the ball of the thumb of the child to allow gripping and control of the piece of cutlery between the ball of the thumb and the four fingers grasping the handle, the longitudinal axis of the operative portion being turned in from the longitudinal axis of the handle so that when the handle is grasped, the operative portion is turned towards the body of the user.

The operative portion is turned in from the handle so that it is not necessary for a child to use muscular effort (something over which young children have little precise control) in order to twist the implement towards their own mouth or the food on a plate. Thus in the case of a spoon, the operative portion is turned in such that the user merely has to lift the piece of cutlery to their mouth without having to twist the piece of cutlery so that the bowl of the spoon enters their mouth. For a fork or "pusher", the operative portion is turned in such that the user can simply push the food around on the plate without having to twist the piece of cutlery.

The longitudinal axis of the operative portion is preferably turned in from 5° to 45° from the longitudinal axis of the handle. For a spoon, the longitudinal axis of the operative portion is more preferably turned in from 25° to 35° whilst the longitudinal axis of the operative portion of a fork is more preferably turned in from 5° to 15° from the longitudinal axis of the handle; this smaller angle for a fork is preferred to discourage use of the fork to bring food to the mouth because even blunted prongs are preferably not brought up to the face. Therefore the prongs should be turned towards the spoon to help transfer of food to the spoon but not turned in enough to point to the face if the fork is raised to the mouth.

When such a piece of cutlery is used by a small child, the child can comfortably hold and grip the handle with a fist, i.e. the clenched fingers, because of the barrel shape particularly at the outer end of the handle. The thumb of the small child rests in the flattened surface adjacent the operative portion and to assist in this the handle is preferably slightly curved to bring the relatively flattened surface towards the ball of the thumb. This enables the child to have a positive and comfortable grip and control.

The handle has a substantially circular cross-section giving the barrel shape but preferably towards the operative portion the handle has a flattened shape so that the cross-section becomes oval. In this oval sectioned region, the flattened surface is provided as a relatively flat, or slightly concave or convex portion of the surface optionally parallel to the major axis of the oval.

Preferably the transverse axis of the flattened surface is at an angle from the transverse axis of the operative portion of from 10° to 60° and more preferably from 20° to 45°. In one preferred embodiment for a spoon, this said transverse axis is at an angle from the transverse axis of the operative portion of from 35° to 45°, and in one preferred embodiment for a fork, this said transverse axis is at an angle from the transverse axis of the operative portion of from 20° to 30°.

The flattened surface preferably extends from a fifth to a half of the length of the whole handle.

The handle is also preferably arched as viewed from the side of the piece of cutlery. The arching can form part of a Z shape for the whole piece of cutlery when viewed from the right-hand side.

The arching of the handle reduces muscular effort or action required by the child as he merely grasps the piece of cutlery and the operative portion assumes the desired position relative to the food on the plate.

The arching is preferably such that when the fist of a child grasps the handle, the ball of the thumb of the child coincides with and so easily rests on the flattened surface without muscular effort to position the thumb, i.e. with the thumb reasonably relaxed.

Preferably, the portion of the handle adjacent the operative portion is turned in less than the rest of the handle in order to balance the weight of the operative portion. This prevents the rolling over of the piece of cutlery and loss of control. Additionally, this enables the ball of the thumb to rest on the relatively flattened surface in its relaxed position without the thumb having to be stretched to reach the surface.

This portion of the handle is preferably turned in from 2° to 15° from the longitudinal axis of the operative portion and extends from a twentieth to third of the length of the handle.

The operative portion of the piece of cutlery is preferably positioned relative to the handle such that in use, the lip of the bowl of the spoon and/or the ends of the prongs of the fork or "pusher" lie in a horizontal plane. Thus, the longitudinal axis of the operative portion should not form of continuation of the arched shape of the handle. In the case of a fork, however, the prongs should be pointed down such that children can use the fork to push food around the plate and onto the spoon and the ends of the prongs do not point at the face if a child does lift the fork to the mouth.

The invention can be applied to all types of cutlery but is particularly applicable to spoons and forks as these items of cutlery are the most commonly used by very young children. Forks may have an operative portion such as prongs or may be in the form of a "pusher" made of a rectangular piece of metal.

In one embodiment of the invention a set of cutlery is provided comprising two pieces, a spoon and a fork or pusher, for use by a young child, each piece having a handle of round, barrel-shape for easy fist-like grasping by a small child, the handle having a relatively flattened surface adjacent the spoon bowl or fork prong or pusher respectively for the ball of the thumb of the child to allow gripping and control of the spoon and fork between the ball of the thumb and the four fingers grasping the operative portion, the longitudinal axis of the operative portion being turned in from the longitudinal axis of the handle so that when the two handles are grasped by the child's hands, the spoon bowl and the fork prongs or pusher are turned in towards the body of the user.

The degree of turning in from the handle for the prongs of a fork is preferably less than the turning in of the bowl for the spoon. The angle of the turning in of the prongs should be enough to point the prongs to the spoon while in the case of the spoon the angle of the bowl should be enough to point the bowl towards the body of the child.

For the spoon, the handle adjacent the operative portion can be wider than the rest of the handle so that food on the bowl does not slip off the back of the bowl when the spoon is raised to the user's mouth. It seems that the wider part of the handle adjacent the operative portion and the overall shape of the piece of cutlery specifically prevents this from happening. Alternatively and/or additionally, it seems that the arching of the handle coupled with the fact that in use the lip of the bowl lies in a horizontal plane seems to prevent this from happening.

In an ordinary spoon, the main problem apart from the child missing his aim and putting food against his face, is that when he lifts his spoon towards his mouth, he tends to flex his wrist to bring the tip of the bowl upwards resulting in the underside of the bowl facing his mouth.

BRIEF SUMMARY OF THE DRAWINGS

The invention will now be described, by way of example, with reference to the accompanying drawings, in which:

FIG. 5 is a perspective view of a fork in accordance with the invention from the front, beneath and one side;

FIG. 6 is a plan view of the fork shown in FIG. 5;

FIG. 7 is an underneath view of the fork shown in FIG. 5; and

FIG. 8 is a side view of the fork shown in FIG. 5.

DESCRIPTION OF THE PREFERRED EMBODIMENTS

Figure 1:
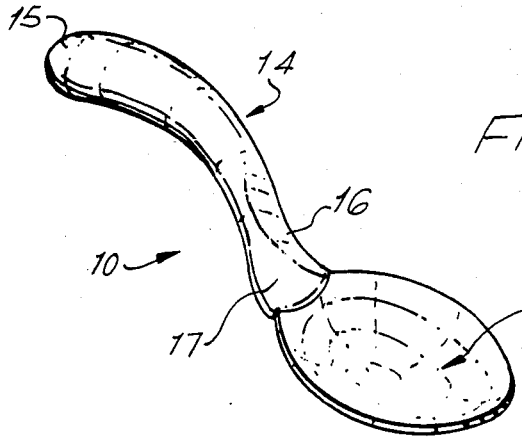
FIG. 1 is a perspective view from the front, above and one side of a spoon in accordance with the invention.

The spoon 10 shown in FIGS. 1 to 4 has an operative portion in the shape of a spoon bowl 12 and a curved handle 14 joined thereto. The handle 14 is generally barrel-shaped at the end 15 remote from the bowl 12 for easy gripping by the four fingers of a young child with little or no muscle control of the hand. The handle gradually transforms into a relatively thinner and flattened region 17 adjacent the bowl 12.

A relatively flattened surface 16 is formed in the top surface of the handle in the region 17 such that the thumb of a child may easily rest on that region. Thus, the ball of the thumb can rest on the surface 16 whilst the four fingers may grasp around the underneath surface of the handle.

The cross-sectional shape of the handle 14 smoothly progresses from a circular section for the barrel end 15 of the handle (see FIG. 4*a*) to an oval shape in the region 17 (see FIG. 4*b*), the major axis 19 of the oval being at an angle from 20° to 60° to the transverse axis 21 (see FIGS. 4*b* and 4*c*) of the bowl 12. Most preferably, the major axis 19 is at an angle from 35° to 45° to the axis 21. The upper face 23 of the oval-shaped region 17 is parallel to the major axis and is relatively flatter than the lower face 25 and constitutes the flattened surface 16.

Figure 2:
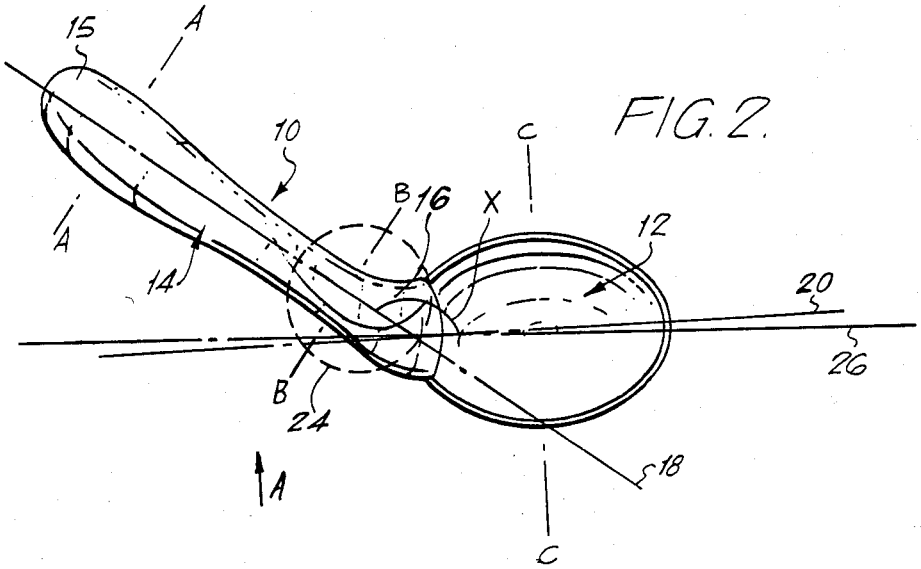
FIG. 2 is a top plan view of the spoon shown in FIG. 1.
Figure 3:
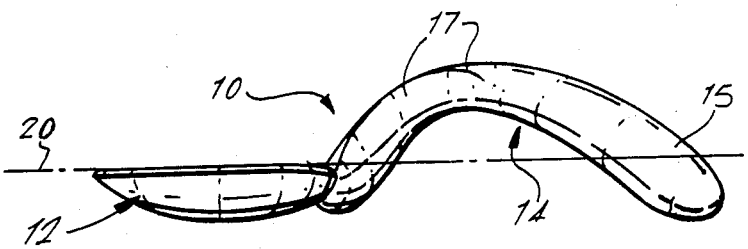
FIG. 3 is a view of the other side of the spoon shown in FIG. 1.

The handle 14 is also substantially arched and forms part of a Z shape when viewed trom the right-hand side, i.e. the direction of the arrow A in FIG. 2, of the spoon such that when the four fingers of the child comfortably grip the handle, the thumb rests on the surface 16 without any muscular effort to position the thumb. The height of the arch may be up to a third of the length of the handle. It will be noted from FIG. 3, however, that the longitudinal axis 20 of the bowl 12 is not a natural extension of the downward arch of the handle so that, when the handle is gripped by a fist, the bowl is kept horizontal.

Figure 4A:
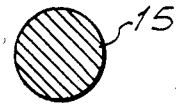
FIG. 4*a* is a cross-section taken along the line A—A of FIG. 2.
Figure 4B:
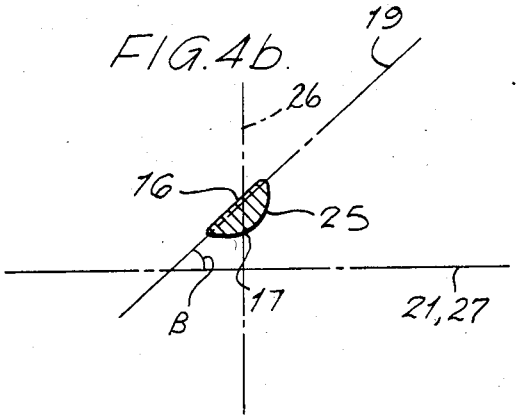
FIG. 4*b* is a cross-section taken along the line B—B of FIG. 2.
Figure 4C:
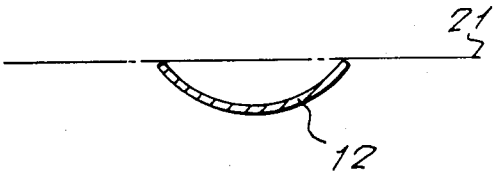
FIG. 4*c* cross-section taken along the line C—C of FIG. 2.

The longitudinal axis 20 of the bowl 12 is turned in from the longitudinal axis 18 of the handle 14 to form an obtuse angle $\alpha$ therebetween. This tends to facilitate correct positioning of the spoon relative the food being eaten or alternatively the mouth of the child and reduces the muscular effort necessary by the child in order to twist the spoon into its mouth. Note, as shown in FIG. 2, that the handle's longitudinal axis 18 and the bowl's longitudinal axis 20 are each positioned in a vertical plane when the spoon 10 is viewed in top plan view. Also note, as shown in FIGS. 2 and 4*b*, that the flattened surface 16 of the handle 14, when viewed in top view or in cross section, is angled downwardly from the handle's top surface toward horizontal plane 27 that includes the spoon bowl's longitudinal axis 21, and is also angled inwardly toward the interior of obtuse angle $\alpha$, relative to vertical plane 26 that includes the handle's longitudinal axis 18.

The longitudinal axis of a piece of cutlery may be turned in over a range of 5° to 45° depending on the bowl 12 and to bring the surface 16 towards the ball of the thumb when in use. The axis 20 of the spoon 10 is turned in approximately 30° from the axis 18.

The portion 24 of the handle 14 (see FIG. 3) adjacent to the bowl 12 is turned in less than the rest of the handle in order to balance the weight of the bowl 12. The portion 24 is preferably turned in (see line 26) from 2° to 15° from the longitudinal axis 20 of the bowl.

Furthermore, this portion 24 of the handle immediately adjacent to the bowl 12 is wider than the rest of the handle so that food on the bowl does not slip off the back of the bowl when the spoon is raised to the user's mouth.

The bowl 12 extends out from the handle 14 such that when the spoon is in use, the lip of the bowl 12 lies in a horizontal plane so that food in the bowl does not drop out.

The various features of the spoon seem to prevent or deter the child, as he lifts the spoon to his mouth, from flexing his wrist to bring the lip of the bowl upwards and causing the food on the bowl to drop off. It seems that the wider part of the handle adjacent the operative portion and the overall shape of the piece of cutlery specifically prevents this from happening. Alternatively, it seems that the arching of the handle coupled with the fact that in use the lip of the bowl lies in a horizontal plane specifically prevents this from happening.

The fork 22 shown in FIGS. 5 to 8 has the same general features of the spoon 10 and for simplicity the equivalent parts are given the same reference numerals. Also separate description of the various parts will not be given except where there are differences and so reference is made to the description of the spoon 10 for a description of equivalent parts of the fork 22.

The axis 18 of the fork is turned in approximately 10° from the axis 20. The axis 18 for the fork prongs 12*a* is turned in less than the axis 18 for the spoon as the prongs are designed only to point towards the spoon rather than towards the body or mouth of the child. The portion 24 is also turned in less than the rest of the handle so as to balance the weight of the operative portion which in this case is the fork prongs 12*a* and to bring the flattened surface 16 towards the ball of the thumb when in use.

The region 17 is also basically oval-shaped in cross-section but the major axis 19 of the oval (see FIG. 4*b*) is at an angle of from 10° to 45° to the transverse axis 21 (see FIG. 4*b*) of the prongs 12*a*.

The fork 22 is arched and forms part of a Z shape when viewed from the right-hand side (see arrow A in FIG. 6).

The prongs 12*a* extend out from the handle 14 such that in use they point down towards the plate and so that the ends of the prongs 12*a* lie in a horizontal plane. The prongs can be used to push food around the plate and onto the spoon.

A set of two pieces of cutlery such as the spoon 10 and fork 22 may be used by a child at the same time. The spoon and fork are designed such that the operative portions turn in towards the body of the user when in use by the child.

Advantageously, the curved barrel shape of the handle allows comfortable gripping by a child in the age range 9 months to 5 years and serves to teach the child how to control the eating implement and further facilitates the correct positioning of the implement relative to the food being eaten or mouth of the child.

A latitude of modification, change and substitution is intended in the foregoing disclosure and in some instances some features of the invention will be employed without a corresponding use of other features. Accordingly it is appropriate that the appended claims be construed broadly and in a manner consistent with the spirit and scope of the invention herein.

I claim:

1. A piece of cutlery comprising a handle having a front end and a remote end, said handle defining a longitudinal axis positioned in a vertical plane when said cutlery piece is viewed in top plan view, said remote end being of a generally round barrel-shaped configuration for easy grasping by the four fingers of a user's hand when said handle is to be held in fist like fashion by the user, an operative portion joined to said handle's front end, said operative portion defining a longitudinal axis also positioned in a vertical plane when said cutlery piece is viewed in top plan view said handle's longitudinal axis and said operative portion's longitudinal axis being angled to form an obtuse angle therebetween when said cutlery piece is viewed in top plan view, and a relatively flattened area defined on said handle's surface adjacent to the joint between said operative portion and said handle's front end, said flattened surface being sized to accommodate, and to locate on said handle, the ball of a user's thumb when the four fingers of the user's hand grasp said handle's remote end in fist like fashion, and said flattened surface being angled downwardly from the top surface of said handle toward a horizontal plane that includes said operative portion's longitudinal axis, and said flattened surface being angled inwardly toward the interior of said obtuse angle, relative to that vertical plane that includes said handle's longitudinal axis as is apparent when said handle's flattened surface is viewed in cross section view or in top plan view, the orientation and location of said flattened surface for a user's thumb cooperating with said handle's remote end to permit a user of relatively young age to grip said cutlery piece, and to control said cutlery piece, so that when said cutlery piece is held by said relatively young user said operative portion can be moved during normal usage of said cutlery piece by said user between the user's food dish and the user's mouth simply by raising the user's arm.

2. A piece of cutlery as set forth in claim 1, said operative portion's longitudinal axis, as viewed in top plan view, being angled between about 5° and about 45° relative to said handle's longitudinal axis.

3. A piece of cutlery as set forth in claim 2, said cutlery piece being a spoon, said spoon's operative bowl portion having its longitudinal axis angled at between about 25° and about 35° relative to said handle's longitudinal axis.

4. A piece of cutlery as set forth in claim 2, said cutlery piece being a fork, said fork's operative prong section having its longitudinal axis angled at between about 5° and about 15° relative to said handle's longitudinal axis.

5. A piece of cutlery as set forth in claim 1, said handle's remote end comprising a substantially circular cross-sectioned portion providing said barrel-shape, and said handle's front end comprising a substantially oval cross-sectioned portion adjacent said operative portion, said flattened surface being provided as a surface of said substantially oval cross-section, said substantially circular-sectioned portion and said substantially oval cross-sectioned portion smoothly merging together one with the other to form said handle.

6. A piece of cutlery as set forth in claim 1, said flattened surface of said handle, when viewed in cross section, defining an angle of between about 10° and about 60° with a horizontal plane that includes said operative portions's longitudinal axis.

7. A piece of cutlery as set forth in claim 6, said cutlery piece being a spoon having a bowl portion, said flattened surface of said handle, when viewed in cross section, defining an angle of between about 35° and about 45° with a horizontal plane that includes said bowl portion's longitudinal axis.

8. A piece of cutlery as set forth in claim 6, said cutlery piece being a fork having a prong portion, said flattened surface of said handle, when viewed in cross section, defining an angle of between about 20° and about 30° with a horizontal plane that includes said prong portion's longitudinal axis.

9. A piece of cutlery as set forth in claim 1, said flattened surface extending along said handle between about one-fifth and about one-half of the length of said handle.

10. A piece of cutlery as set forth in claim 1, said handle being substantially arched when viewed from a side elevation view.

11. A piece of cutlery as set forth in claim 10, said arched handle comprising an arched portion that, when said cutlery piece is viewed in side elevation view, extends above a horizontal plane that includes said operative portion's longitudinal axis, said handle's remote end being positioned adjacent to or below the immediately aforementioned horizontal plane.

12. A piece of cutlery as set forth in claim 1, said handle's front end comprising a connector portion adjacent said operative portion, said connector portion having a longitudinal axis angled less than the longitudinal axis of said handle's remote end, relative to said operative portion's longitudingal axis, in order to balance the weight of said operative portion.

13. A piece of cutlery as set forth in claim 12, said longitudinal axis of said handle's connector portion being angled between about 2° and about 15° relative to said operative portion's longitudinal axis.

14. A piece of cutlery as set forth in claim 13, said handle's connector portion having a length between about one-twentieth and about one-third of the handle's length.

* * * * *